US009618005B2

(12) United States Patent
Segawa

(10) Patent No.: US 9,618,005 B2
(45) Date of Patent: Apr. 11, 2017

(54) VARIABLE NOZZLE UNIT AND VARIABLE-GEOMETRY TURBOCHARGER

(71) Applicant: IHI Corporation, Koto-ku (JP)

(72) Inventor: Kenichi Segawa, Tokyo (JP)

(73) Assignee: IHI Corporation, Koto-ku (JP)

( * ) Notice: Subject to any disclaimer, the term of this patent is extended or adjusted under 35 U.S.C. 154(b) by 340 days.

(21) Appl. No.: 14/529,780

(22) Filed: Oct. 31, 2014

(65) Prior Publication Data

US 2015/0056067 A1 Feb. 26, 2015

Related U.S. Application Data

(63) Continuation of application No. PCT/JP2013/064589, filed on May 27, 2013.

(30) Foreign Application Priority Data

May 29, 2012 (JP) ..... 2012-121972

(51) Int. Cl.

| | |
|---|---|
| ***F04D 27/00*** | (2006.01) |
| ***F04D 29/12*** | (2006.01) |
| ***F01D 11/00*** | (2006.01) |
| ***F01D 17/16*** | (2006.01) |
| *F02B 37/24* | (2006.01) |

(52) U.S. Cl.

CPC ..... *F04D 27/002* (2013.01); *F01D 11/005* (2013.01); *F01D 17/165* (2013.01); *F04D 29/122* (2013.01); *F02B 37/24* (2013.01); *F05D 2220/40* (2013.01); *F05D 2240/58* (2013.01); *F05D 2240/581* (2013.01); *F05D 2250/75* (2013.01)

(58) Field of Classification Search

CPC .... F01D 11/005; F01D 17/165; F04D 27/002; F04D 29/122; F02B 37/24; F05D 2220/40; F05D 2240/58; F05D 2250/75

See application file for complete search history.

(56) References Cited

U.S. PATENT DOCUMENTS 3,737,247 A * 6/1973 Horning ..... F01D 9/045 415/195
4,185,842 A 1/1980 Magara
(Continued)

FOREIGN PATENT DOCUMENTS

CN 1694998 A 11/2005
DE 24 08 198 A1 9/1975
(Continued)

OTHER PUBLICATIONS

Extended European Search Report issued Mar. 4, 2016 in Patent Application 13797334.3.

(Continued)

*Primary Examiner* — Igor Kershteyn
(74) *Attorney, Agent, or Firm* — Oblon, McClelland, Maier & Neustadt, L.L.P.

(57) ABSTRACT

An annular seal flange is formed at an inner peripheral edge portion of an upstream-side seal ring. The seal flange projects in a downstream direction. When seal rings are viewed from radially inside, the seal flange of the upstream-side seal ring is designed to at least partially occlude an end gap of the downstream-side (the most downstream-side) seal ring.

4 Claims, 7 Drawing Sheets

(56) References Cited

U.S. PATENT DOCUMENTS

| | | | | |
|---|---|---|---|---|
| 4,242,040 | A * | 12/1980 | Swearingen | F01D 17/165 415/113 |
| 5,964,574 | A * | 10/1999 | Meier | F01D 9/045 415/110 |
| 8,485,779 | B2 * | 7/2013 | Matsuyama | F01D 17/165 415/164 |
| 8,545,172 | B2 * | 10/2013 | Severin | F01D 25/145 415/164 |
| 9,074,687 | B2 * | 7/2015 | Matsuyama | F16J 15/0887 |
| 2004/0081567 | A1 | 4/2004 | Boening | |
| 2007/0130943 | A1 | 6/2007 | Sausse et al. | |
| 2007/0175216 | A1 * | 8/2007 | Kobayashi | F01D 17/165 60/605.2 |
| 2010/0310365 | A1 * | 12/2010 | Matsuyama | F01D 11/005 415/212.1 |
| 2011/0167817 | A1 | 7/2011 | Sausse et al. | |

FOREIGN PATENT DOCUMENTS

| | | | |
|---|---|---|---|
| DE | 28 29 352 | A1 | 1/1979 |
| EP | 2 243 939 | A1 | 10/2010 |
| JP | 08-303590 | A | 11/1996 |
| JP | 2006-125588 | A | 5/2006 |
| JP | 2008-106823 | A | 5/2008 |
| JP | 2008-215083 | A | 9/2008 |
| JP | 2008-286079 | A | 11/2008 |
| JP | 2009-243300 | A | 10/2009 |
| JP | 2009-243431 | A | 10/2009 |
| JP | 2009-257090 | A | 11/2009 |
| JP | 2010-001863 | A | 1/2010 |
| JP | 2010-190092 | A | 9/2010 |
| WO | WO 2004/022926 | A1 | 3/2004 |

OTHER PUBLICATIONS

Chinese Office Action issued Mar. 31, 2016 in Chinese Patent Application No. 201380023481.1.

International Search Report Issued on Jul. 9, 2013 for PCT/JP2013/064589 Filed on May 27, 2013 (English Language).

International Written Opinion Issued on Jul. 9, 2013 for PCT/JP2013/064589 Filed on May 27, 2013.

* cited by examiner

VARIABLE NOZZLE UNIT AND VARIABLE-GEOMETRY TURBOCHARGER

CROSS REFERENCE TO RELATED APPLICATIONS

This application is a continuation application of International Application No. PCT/JP2013/064589, filed on May 27, 2013, which claims priority to Japanese Patent Application No. 2012-121972, filed on May 29, 2012, the entire contents of which are incorporated by references herein.

BACKGROUND OF THE INVENTION

1. Field of the Invention

The present invention relates to a variable nozzle unit which can change a passage area for (a flow rate of) an exhaust gas to be supplied to a turbine impeller side in a variable-geometry turbocharger, and the like.

2. Description of the Related Art

A typical variable nozzle unit used in a variable-geometry turbocharger is disposed between a turbine scroll passage and a gas discharge port inside a turbine housing in such a way as to surround a turbine impeller. A specific configuration of such a typical variable nozzle unit (a conventional variable nozzle unit) is as follows (see Japanese Patent Application Laid-Open Publication No. 2006-125588 (FIG. 9 and FIG. 10)).

A nozzle ring is disposed in the turbine housing. As shown in FIG. 6A and FIG. 6B, a shroud ring 157 is provided integrally with the nozzle ring (not shown) at a position away from and opposed to the nozzle ring in an axial direction of a turbine impeller 129. Meanwhile, the shroud ring 157 includes a cylindrical shroud portion 163 which is placed on an inner peripheral edge side, which projects to the gas discharge port side (a downstream side), and which covers outer edges of multiple turbine blades 133 of the turbine impeller 129. In addition, the shroud portion 163 of the shroud ring 157 is placed inside of an annular step portion 141 formed on an inlet side of the gas discharge port inside the turbine housing. A ring groove 165 is formed in an outer peripheral surface of the shroud portion 163 of the shroud ring 157.

Multiple variable nozzles (not shown) are disposed at regular intervals in a circumferential direction between opposed surfaces of the nozzle ring (not shown) and the shroud ring 157. Each variable nozzle is turnable in forward and reverse directions (opening and closing directions) about its shaft center which is in parallel with a shaft center Z of the turbine impeller 129. Here, when the multiple variable nozzles are synchronously turned in the forward direction (the opening direction), a passage area for an exhaust gas to be supplied to the turbine impeller 129 side is increased. On the other hand, when the multiple variable nozzles are synchronously turned in the reverse direction (the closing direction), the passage area for the exhaust gas is decreased.

Multiple seal rings (an upstream-side seal ring 183 and a downstream-side seal ring 185) are provided in pressure-contact, by their own elastic forces, with an inner peripheral surface of the step portion 141 of the turbine housing. The multiple seal rings 183 and 185 suppress leakage of the exhaust gas from the turbine scroll passage side. Meanwhile, inner peripheral edge portions of the seal rings 183 and 185 are fitted into the ring groove 165 of the shroud ring. Here, a circumferential position of an end gap 183*f* of the upstream-side seal ring 183 is displaced from a circumferential position of an end gap 185*f* of the downstream-side seal ring 185.

Note that FIG. 6A is a view taken along the VIA-VIA line in FIG. 6B, and FIG. 6B is a view showing part of the conventional variable nozzle unit. In the drawings, "L" indicates leftward and "R" indicates rightward.

SUMMARY OF THE INVENTION

In the meantime, as shown in FIG. 7A, when part of the exhaust gas flows from the end gap 183*f* of the upstream-side seal ring 183 into a space on a bottom surface side of the ring groove 165 of the shroud ring 157 while the variable-geometry turbocharger is in operation, the part of the exhaust gas flows along the ring groove 165 of the shroud ring 157 and then flows out from the end gap 185*f* of the downstream-side seal ring 185 to the gas discharge port side. In other words, although the multiple seal rings 183 and 185 suppress the leakage of the exhaust gas from the turbine scroll passage side, the area of an opening (the area of a hatched portion) of the end gap 185*f* of the downstream-side seal ring 185, when the multiple seal rings 183 and 185 are viewed from radially inside as shown in FIG. 7B, constitutes a final leakage area of the multiple seal rings 183 and 185. Hence, the leakage of the exhaust gas via the end gaps 183*f* and 185*f* of the multiple seal rings 183 and 185 cannot be sufficiently prevented. For this reason, there is a problem of a difficulty in improving turbine efficiency of the variable-geometry turbocharger to a high level.

Here, FIG. 7A is an enlarged view showing the multiple seal rings and their vicinity in the conventional variable nozzle unit, and FIG. 7B is an enlarged view of a part along arrowed lines VIIB-VIIB in FIG. 6A. In the drawings, "L" indicates leftward while "R" indicates rightward.

Accordingly, it is an object of the present invention to provide a variable nozzle unit which can solve the aforementioned problem.

A first aspect of the present invention is a variable nozzle unit disposed between a turbine scroll passage and a gas discharge port inside a turbine housing of a variable-geometry turbocharger in such a way as to surround a turbine impeller, and capable of changing a passage area for (a flow rate of) an exhaust gas to be supplied to the turbine impeller side. Its gist is as follows. The variable nozzle unit is includes: a nozzle ring disposed inside the turbine housing; a shroud ring provided integrally with the nozzle ring at a position away from and opposed to the nozzle ring in an axial direction of the turbine impeller, the shroud ring including a cylindrical shroud portion placed on an inner peripheral edge side, projecting to the gas discharge port side (to a downstream side), and being configured to cover outer edges of multiple turbine blades of the turbine impeller, the shroud portion being placed on an inside of an annular step portion formed on an inlet side of the gas discharge port inside the turbine housing, and the shroud ring including a ring groove (a circumferential groove) formed in an outer peripheral surface of the shroud portion; multiple variable nozzles disposed in a circumferential direction between opposed surfaces of the nozzle ring and the shroud ring, each variable nozzle being turnable in forward and reverse directions (opening and closing directions) about a shaft center in parallel with a shaft center of the turbine. impeller; and multiple seal rings provided in pressure-contact by their own elastic forces with an inner peripheral surface of the step portion of the turbine housing, an inner peripheral edge portion of each seal ring being fitted into the ring groove of the shroud ring and being configured to suppress leakage of the exhaust gas from the turbine scroll passage side (an opposite surface side from the opposed surface of the shroud ring). A seal flange projecting in a downstream direction (toward the gas discharge port) is formed at an inner peripheral edge portion of at least one (including an upstream-side seal ring) of the multiple seal rings except the most downstream-side seal ring (closest to the gas discharge port). When the multiple seal rings are viewed from radially inside, the seal flange of the at least one seal ring is designed to at least partially occlude (cover) an end gap of the most downstream-side seal ring.

It should be noted that in the specification and the scope of claims in the subject application, the meaning of "disposed" includes being directly disposed, and being indirectly disposed with the assistance of another member; and the meaning of "provided" includes being directly provided, and being indirectly provided with the assistance of another member. In addition, "upstream" means being upstream when viewed in the direction in which the mainstream of the exhaust gas flows, and "downstream" means being downstream when viewed in the direction in which the mainstream of the exhaust gas flows.

A second aspect of the present invention is a variable-geometry turbocharger configured to supercharge air to be supplied to an engine by using energy of an exhaust gas from the engine. Its gist is that the variable-geometry turbocharger includes the variable nozzle unit of the first aspect.

According to the present invention, the leakage of the exhaust gas via the end gaps of the multiple seal rings can be sufficiently prevented while the variable-geometry turbocharger is in operation. Thus, it is possible to improve turbine efficiency of the variable-geometry turbocharger.

DESCRIPTION OF THE PREFERRED EMBODIMENTS

Figure 1B:
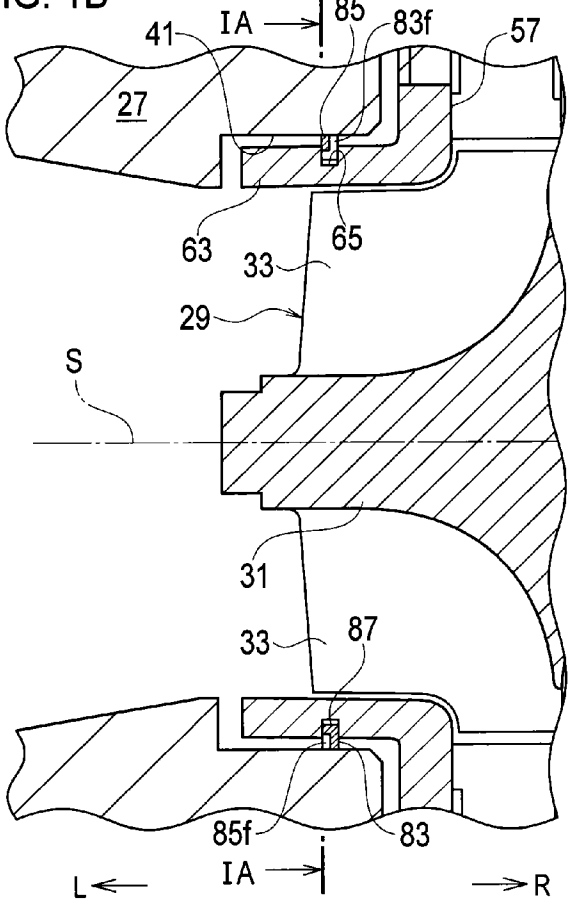
FIG. 1B is a view showing a portion indicated with an arrow IB in FIG. 3.

An embodiment of the present invention will be described with reference to FIG. 1 to FIG. 4. In the drawings, "R" indicates rightward while "L" indicates leftward.

Figure 4:
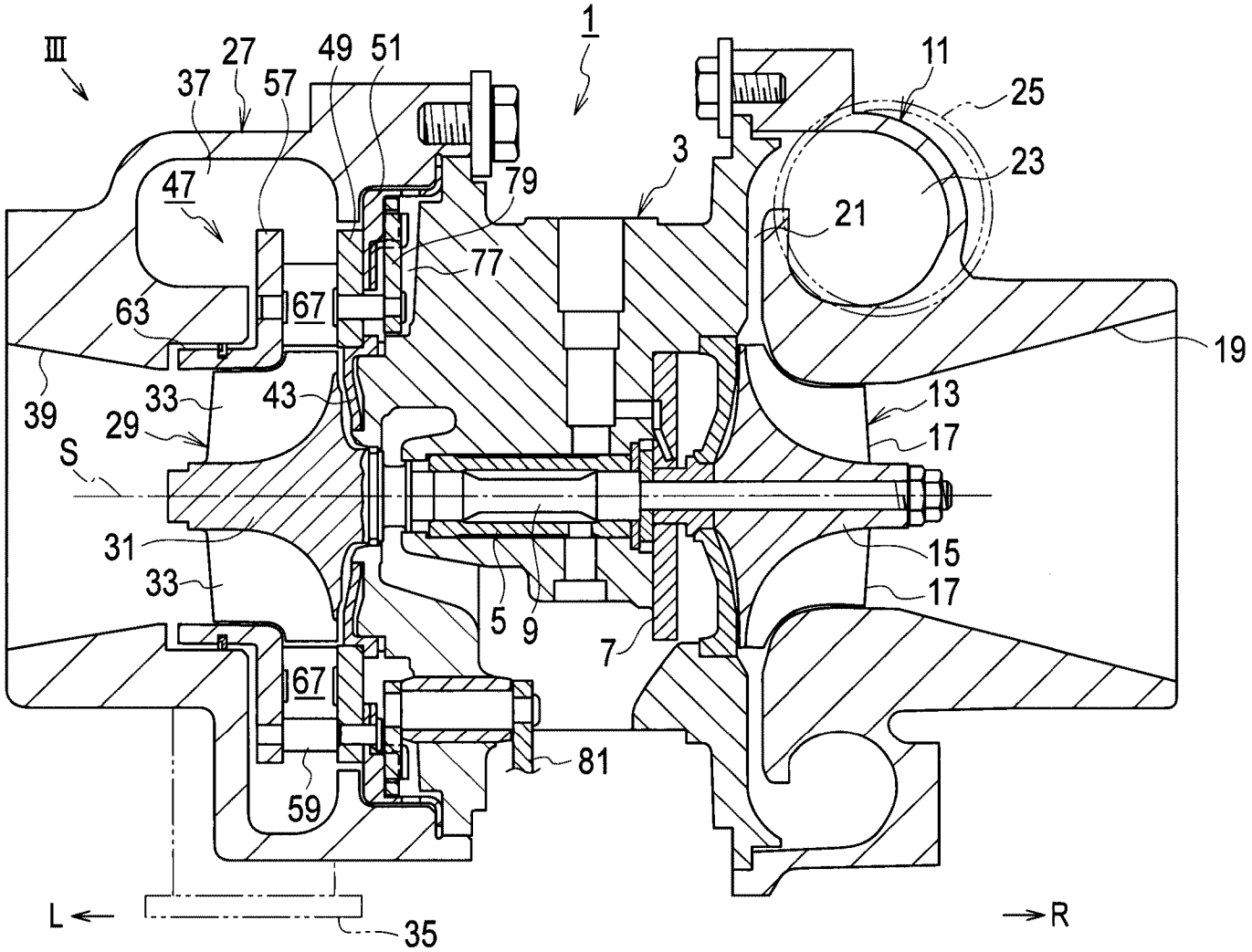
FIG. 4 is a front sectional view of a variable-geometry turbocharger according to the embodiment of the present invention.

As shown in FIG. 4, a variable-geometry turbocharger 1 according to the embodiment of the present invention is configured to supercharge (compress) air to be supplied to an engine (not shown) by using energy of an exhaust gas from the engine. Here, a specific configuration and the like of the variable-geometry turbocharger 1 are as follows.

The variable-geometry turbocharger 1 includes a bearing housing 3, and a radial bearing 5 and a pair of thrust bearings 7 are provided inside the bearing housing 3. Moreover, a rotor shaft (a turbine shaft) 9 extending in a right-left direction is rotatably provided to the multiple bearings 5 and 7. In other words, the rotor shaft 9 is rotatably provided to the bearing housing 3 with the assistance of the multiple bearings 5 and 7.

A compressor housing 11 is provided on a right side of the bearing housing 3. Inside the compressor housing 11, a compressor impeller 13 configured to compress the air by using a centrifugal force is provided rotatably about its shaft center (in other words, a shaft center of the rotor shaft 9) S. Moreover, the compressor impeller 13 includes a compressor wheel 15 integrally connected to a right end portion of the rotor shaft 9, and multiple compressor blades 17 provided on an outer peripheral surface of the compressor wheel 15 at regular intervals in the circumferential direction thereof.

An air introduction port 19 for introducing the air is formed on an inlet side of the compressor impeller 13 of the compressor housing 11 (at a right side portion of the compressor housing 11). The air introduction port 19 is connectable to an air cleaner (not shown) configured to clean up the air. Meanwhile, an annular diffuser passage 21 configured to boost the compressed air is formed on an outlet side of the compressor impeller 13 between the bearing housing 3 and the compressor housing 11. The diffuser passage 21 communicates with the air introduction port 19. In addition, a compressor scroll passage 23 in a scroll shape is formed inside the compressor housing 11. The compressor scroll passage 23 communicates with the diffuser passage 21. Moreover, an air discharge port 25 for discharging the compressed air is formed at an appropriate position in the compressor housing 11. The air discharge port 25 communicates with the compressor scroll passage 23, and is connectable to an intake manifold (not shown) of the engine.

Figure 3:
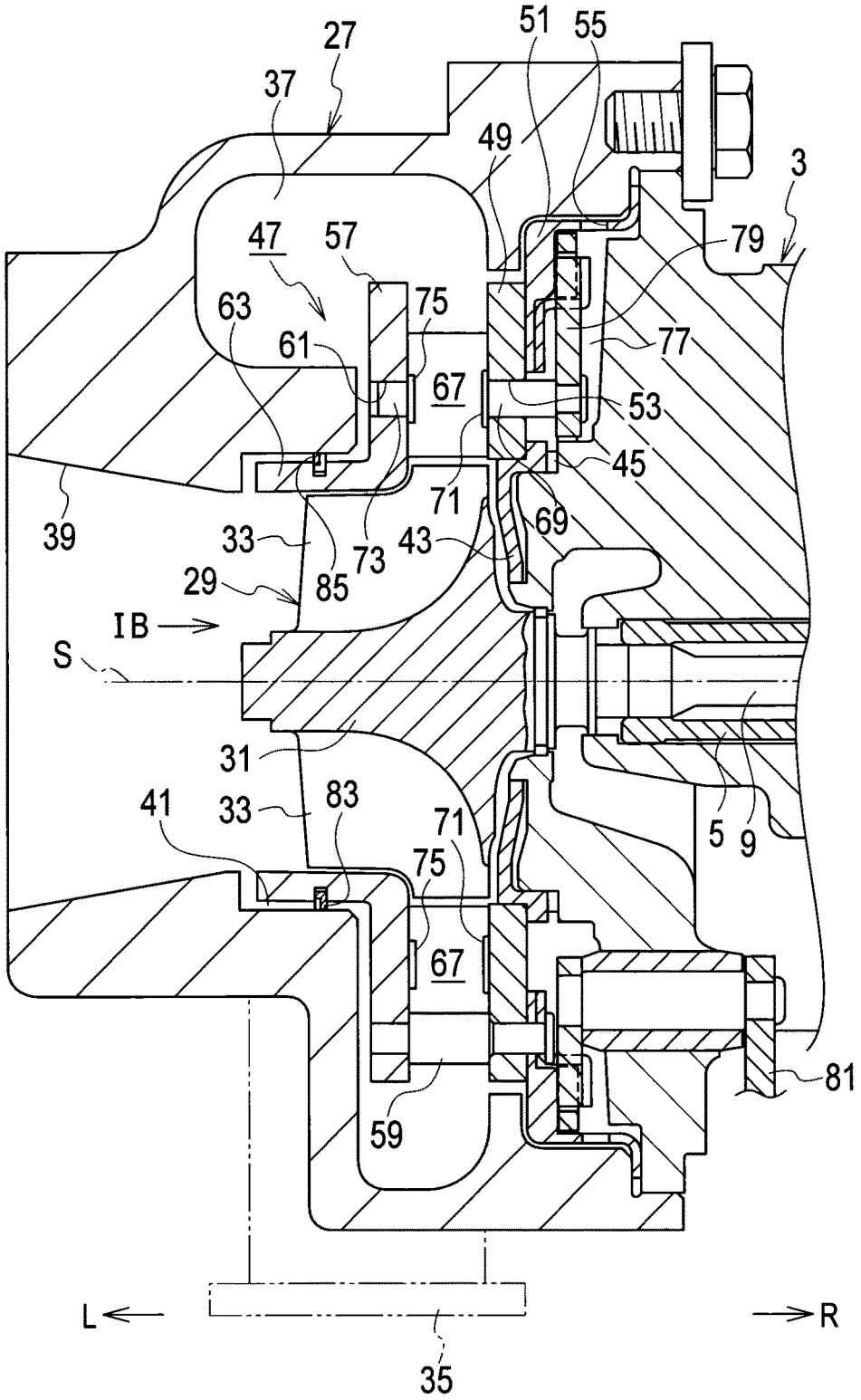
FIG. 3 is an enlarged view of a portion indicated with an arrow III in FIG. 4.

As shown in FIG. 3 and FIG. 4, a turbine housing 27 is provided on a left side of the bearing housing 3. A turbine impeller 29 configured to generate a rotational force (rotational torque) by using the pressure energy of the exhaust gas is provided rotatably about the shaft center (a shaft center of the turbine impeller 29, in other words, the shaft center of the rotor shaft 9) S. In the meantime, the turbine impeller 29 includes a turbine wheel 31 integrally provided at a left end portion of the rotor shaft 9, and multiple turbine blades 33 provided on an outer peripheral surface of the turbine wheel 31 at regular intervals in the circumferential direction thereof.

A gas introduction port 35 for introducing the exhaust gas is formed at an appropriate position in the turbine housing 27. The gas introduction port 35 is connectable to an exhaust manifold (not shown) of the engine. In addition, a turbine scroll passage 37 in a scroll shape is formed inside the turbine housing 27. The turbine scroll passage 37 communicates with the gas introduction port 35. Moreover, a gas discharge port 39 for discharging the exhaust gas is formed on an outlet side of the turbine impeller 29 of the turbine housing 27 (at a left side portion of the turbine housing 27). The gas discharge port 39 communicates with the turbine scroll passage 37, and is connectable to an exhaust emission control system (not shown) configured to clean up the exhaust gas. Furthermore, an annular step portion 41 is formed on an inlet side of the gas discharge port 39 inside the turbine housing 27.

Here, an annular heat shield plate 43 configured to block heat from the turbine impeller 29 side is provided on a left side surface of the bearing housing 3, and a wave washer 45 is provided between the left side surface of the bearing housing 3 and an outer edge portion of the heat shield plate 43.

A variable nozzle unit 47, which can change a passage area for (a flow rate of) the exhaust gas to be supplied to the turbine impeller 29 side, is provided between the turbine scroll passage 37 and the gas discharge port 39 inside the turbine housing 27 in such a way as to surround the turbine impeller 29. A specific configuration of the variable nozzle unit 47 is as follows.

As shown in FIG. 3, inside the turbine housing 27, a nozzle ring 49 is disposed concentrically with the turbine impeller 29 with the assistance of an attachment ring 51. An inner peripheral edge portion of the nozzle ring 49 is fitted in a state of pressure-contact into an outer peripheral edge portion of the heat shield plate 43 by a biasing force of the wave washer 45. Meanwhile, multiple (only one of which is shown) first support holes 53 are formed to penetrate the nozzle ring 49 at regular intervals in a circumferential direction. Here, an outer peripheral edge portion of the attachment ring 51 is sandwiched between the bearing housing 3 and the turbine housing 27, and multiple (only one which is shown) through-holes 55 are formed in the attachment ring 51.

At a position away from and opposed to the nozzle ring 49 in the right-left direction (the axial direction of the turbine impeller 29), a shroud ring 57 is provided integrally with the nozzle ring 49 and concentrically with the turbine impeller 29 with the assistance of multiple connecting pins 59. Meanwhile, multiple (only one of which is shown) second support holes 61 are formed in the shroud ring 57 at regular intervals in a circumferential direction in a way to conform to the multiple first support holes 53 in the nozzle ring 49. Furthermore, the shroud ring 57 includes a cylindrical shroud portion 63 placed on its inner peripheral edge side, projecting to the gas discharge port 39 side (a downstream side), and covering outer edges of the multiple turbine blades 33. The shroud portion 63 is placed inside of the step portion 41 of the turbine housing 27, and a ring groove (a circumferential groove) 65 (see FIG. 2) is formed in an outer peripheral surface of the shroud portion 63. Here, the multiple connecting pins 59 have a function to define a clearance between opposed surfaces of the nozzle ring 49 and the shroud ring 57.

Multiple variable nozzles 67 are disposed between the opposed surfaces of the nozzle ring 49 and the shroud ring 57 at regular intervals in the circumferential direction. Each variable nozzle 67 is turnable in forward and reverse directions (opening and closing directions) about its shaft center that is in parallel with the shaft center S of the turbine impeller 29. In addition, a first nozzle shaft 69 to be turnably supported by the corresponding first support hole 53 in the nozzle ring 49 is integrally formed on a right side surface of each variable nozzle 67 (a side surface on one side in the axial direction of the turbine impeller 29). Each variable nozzle 67 includes a first nozzle flange portion 71, which is placed on a base end side of the first nozzle shaft 69 and is capable of coming into contact with the opposed surface of the nozzle ring 49. Moreover, a second nozzle shaft 73 to be supported by the corresponding second support hole 61 in the shroud ring 57 is integrally formed on a left side surface of each variable nozzle 67 (a side surface on the other side in the axial direction of the turbine impeller 29) and coaxially with the first nozzle shaft 69. Each variable nozzle 67 includes a second nozzle flange portion 75, which is placed on a base end side of the second nozzle shaft 73 and is capable of coming into contact with the opposed surface of the shroud ring 57.

A link mechanism (a synchronization mechanism) 79 for synchronously turning the multiple variable nozzles 67 is disposed inside an annular link chamber 77 that is defined between the bearing housing 3 and the nozzle ring 49. Here, the link mechanism 79 is formed from a publicly known configuration disclosed in Japanese Patent Laid-Open Application Publications Nos. 2009-243431, 2009-243300, and the like, and is connected via a power transmission mechanism 81 to a turn actuator (not shown), such as a motor or a cylinder, which is configured to turn the multiple variable nozzles 67 in the opening and closing directions.

Figure 1A:
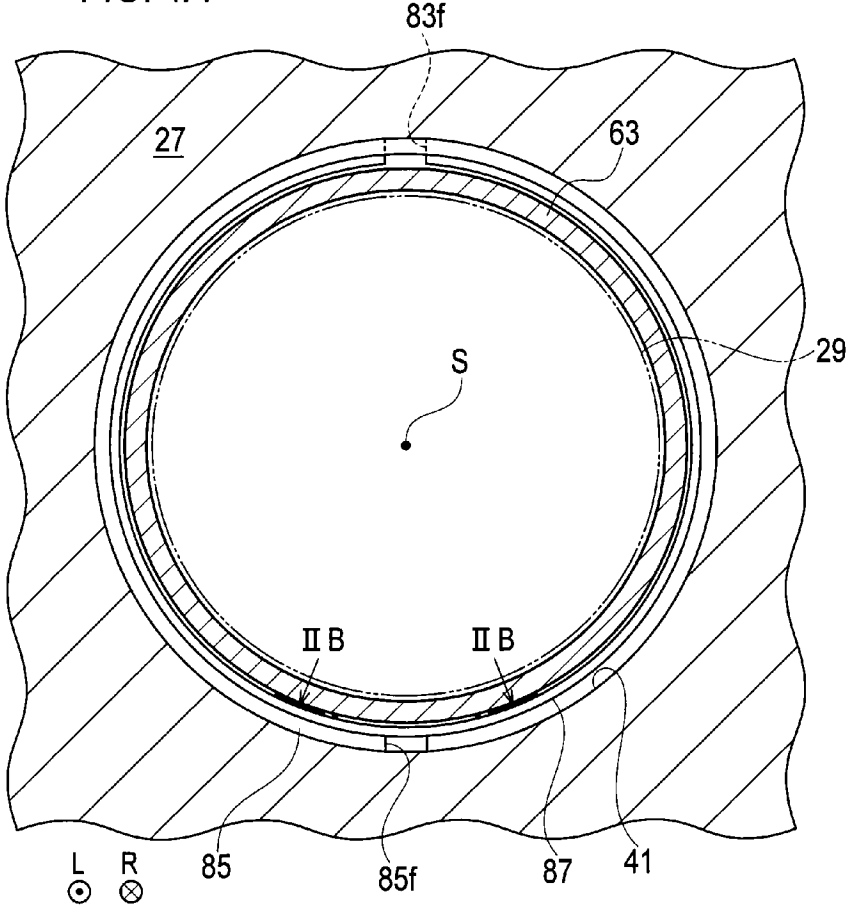
FIG. 1A is a view taken along the IA-IA line in FIG. 1B.
Figure 2B:
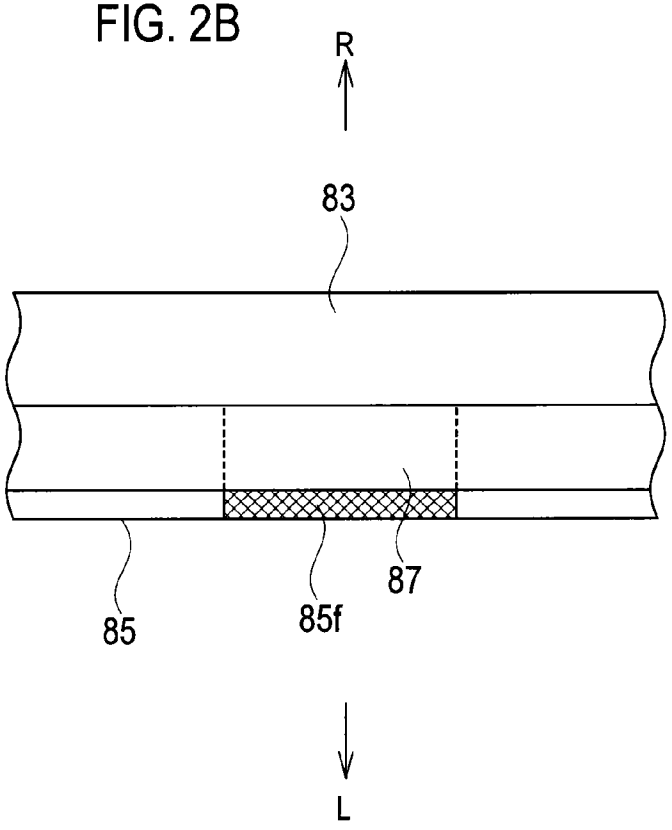
FIG. 2B is an enlarged view taken and viewed along an arrowed line IIB-IIB in FIG. 1A.
Figure 2A:
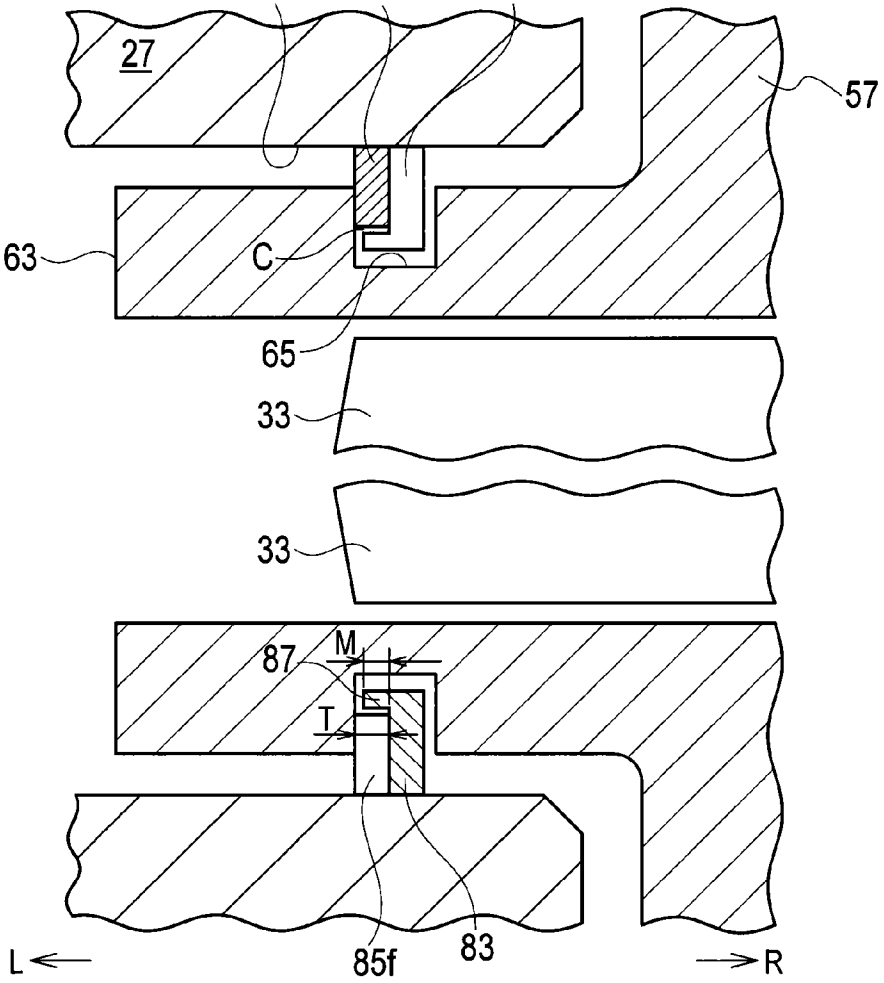
FIG. 2A is an enlarged view showing multiple seal rings and their vicinity in a variable nozzle unit according to an embodiment of the present invention.

As shown in FIG. 1A, FIG. 1B, and FIG. 2A, two (multiple) seal rings 83 and 85 (an upstream-side seal ring 83 and a downstream-side seal ring 85) are provided in pressure-contact with an inner peripheral surface of the step portion 41 of the turbine housing 27 by their own elastic forces (elastic forces of the two seal rings 83 and 85). The two seal rings 83 and 85 are configured to suppress leakage of the exhaust gas from the turbine scroll passage 37 side (the opposite surface side from the opposed surface of the shroud ring 57). Meanwhile, inner peripheral edge portions of the seal rings 83 and 85 are fitted into the ring groove 65 of the shroud ring 57. Here, a circumferential position (an angular position in the circumferential direction) of an end gap 83*f* of the upstream-side seal ring 83 is displaced from a circumferential position of an end gap 85*f* of the downstream-side seal ring 85.

An annular seal flange 87 projecting in a downstream direction (to the gas discharge port 39 side) is formed on the inner peripheral edge portion of the upstream-side seal ring 83. In other words, a cross-sectional shape of the upstream-side seal ring 83 takes on an L-shape. In the meantime, a clearance C is defined between an outer peripheral surface of the seal flange 87 of the upstream-side seal ring 83 and an inner peripheral surface of the downstream-side seal ring 85. Moreover, a projection length M of the upstream-side seal ring 83 is set equal to or below a thickness T of the downstream-side seal ring 85. As shown in FIG. 2B, when the multiple seal rings 83 and 85 are viewed from radially inside, the seal flange 87 of the upstream-side seal ring 83 is designed to at least partially (partially or entirely) occlude (cover) the end gap 85*f* of the downstream-side (the most downstream-side) seal ring 85.

The seal rings 83 and 85 may be made of materials having the same characteristics (for instance, in light of a heat resistance performance, the linear expansion coefficient, and the like) or may be made of materials having mutually different characteristics. Examples of such materials include a heat-resistant alloy. In the meantime, the materials of the seal rings 83 and 85 may be selected in consideration of the linear expansion coefficient. For instance, the seal ring 83 and the seal ring 85 may be made of materials having the same linear expansion coefficient. Alternatively, the seal ring 83 may be made of a material having a lower linear expansion coefficient than the linear expansion coefficient of the seal ring 85. In the latter case, the seal ring 85 can secure a stable sealing performance. Meanwhile, the surfaces of the seal rings 83 and 85 may be subjected to surface coating in order to reduce friction coefficients or to increase hardnesses thereof.

Here, the seal flange 87 of the upstream-side seal ring 83 does not always have to be annularly formed as long as the seal flange 87 of the upstream-side seal ring 83 is designed to at least partially occlude the end gap 85*f* of the downstream-side seal ring 85 as described previously.

Next, the operation and effect of the embodiment of the present invention will be described.

The exhaust gas introduced from the gas introduction port 35 passes through the turbine scroll passage 37 and flows from the inlet side to the outlet side of the turbine impeller 29. Hence, it is possible to generate the rotational force (the rotational torque) by using the pressure energy of the exhaust gas and to rotate the rotor shaft 9 and the compressor impeller 13 integrally with the turbine impeller 29. This makes it possible to compress the air introduced from the air introduction port 19, to discharge the air from the air discharge port 25 via the diffuser passage 21 and the compressor scroll passage 23, and thus to supercharge (compress) the air to be supplied to the engine.

While the variable-geometry turbocharger 1 is in operation, if the number of revolutions of the engine is in a high-revolution range and the flow rate of the exhaust gas is high, the multiple variable nozzles 67 are synchronously turned in the forward direction (the opening direction) while operating the link mechanism 79 with the turn actuator. Thus, a gas passage area (throat areas of the variable nozzles 67) for the exhaust gas to be supplied to the turbine impeller 29 side is increased to supply a large amount of the exhaust gas to the turbine impeller 29 side. On the other hand, if the number of revolutions of the engine is in a low-revolution range and the flow rate of the exhaust gas is low, the multiple variable nozzles 67 are synchronously turned in the reverse direction (the closing direction) while operating the link mechanism 79 with the turn actuator. Thus, the gas passage area for the exhaust gas to be supplied to the turbine impeller 29 side is decreased to raise a flow velocity of the exhaust gas, and to ensure sufficient work of the turbine impeller 29. Thereby, it is possible to generate the rotational force sufficiently and stably with the turbine impeller 29 regardless of the size of the flow rate of the exhaust gas, while suppressing the leakage of the exhaust gas from the turbine scroll passage 37 side by using the multiple seal rings 83 and 85.

Here, the seal flange 87 that projects in the downstream direction is formed on the inner peripheral edge portion of the upstream-side seal ring 83, and when the multiple seal rings 83 and 85 are viewed from radially inside, the seal flange 87 of the upstream-side seal ring 83 is designed to at least partially occlude the end gap 85*f* of the downstream-side seal ring 85. Accordingly, it is possible to reduce the area of an opening (the area of a hatched region in FIG. 2B) of the end gap 85*f* of the downstream-side seal ring 85 when the multiple seal rings 83 and 85 are viewed from radially inside, in other words, a final leakage area of the multiple seal rings 83 and 85. Hence, if part of the exhaust gas flows from the end gap 83*f* of the upstream-side seal ring 83 into a space on a bottom surface side of the ring groove 65 of the shroud ring 57 while the variable-geometry turbocharger 1 is in operation, the exhaust gas can be surely prevented from flowing out from the end gap 85*f* of the downstream-side seal ring 85 to the gas discharge port 39 side. In other words, it is possible to surely prevent the leakage of the exhaust gas via the end gap 83*f* of the upstream-side seal ring 83 and the end gap 85*f* of the downstream-side seal ring 85.

Hence, according to the embodiment of the present invention, it is possible to surely prevent the leakage of the exhaust gas via the end gap 83*f* of the upstream-side seal ring 83 and the end gap 85*f* of the downstream-side seal ring 85 while the variable-geometry turbocharger 1 is in operation, and thereby to improve turbine efficiency of the variable-geometry turbocharger 1 to a high level.

(Modified Example)

A modified example of the embodiment of the present invention will be described with reference to FIG. 5A and FIG. 5B. In the drawings, "R" indicates rightward while "L" indicates leftward.

Figure 5B:
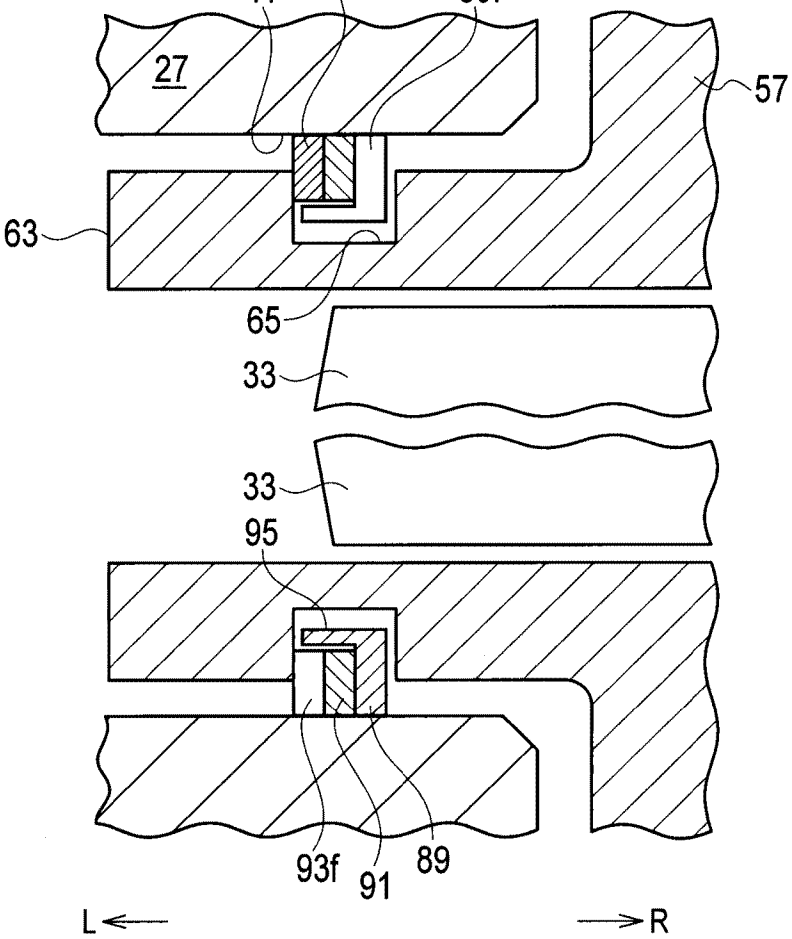
FIG. 5A and FIG. 5B are enlarged views showing multiple seal rings and their vicinity in a variable nozzle unit according to a modified example of the embodiment of the present invention.
Figure 5A:
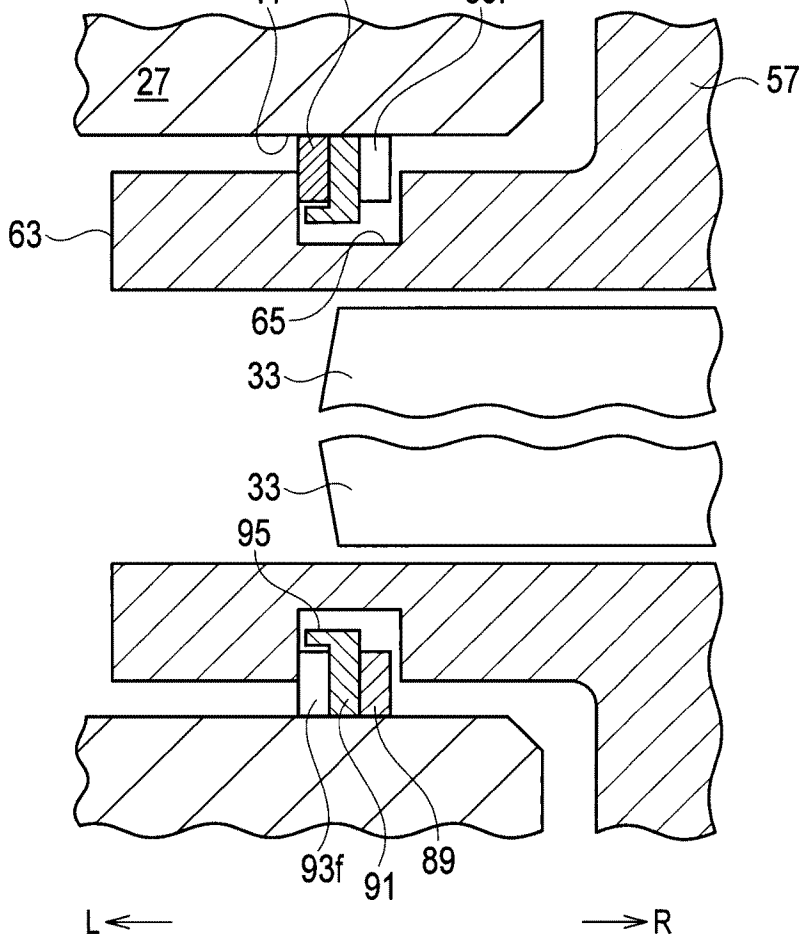
Figure 6B:
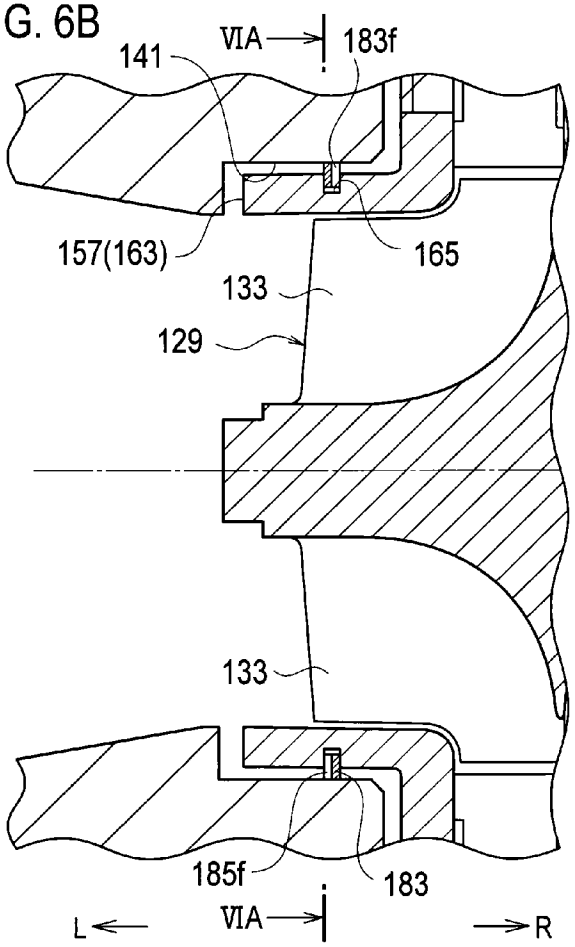
FIG. 6B is a view showing part of a conventional variable nozzle unit.
Figure 6A:
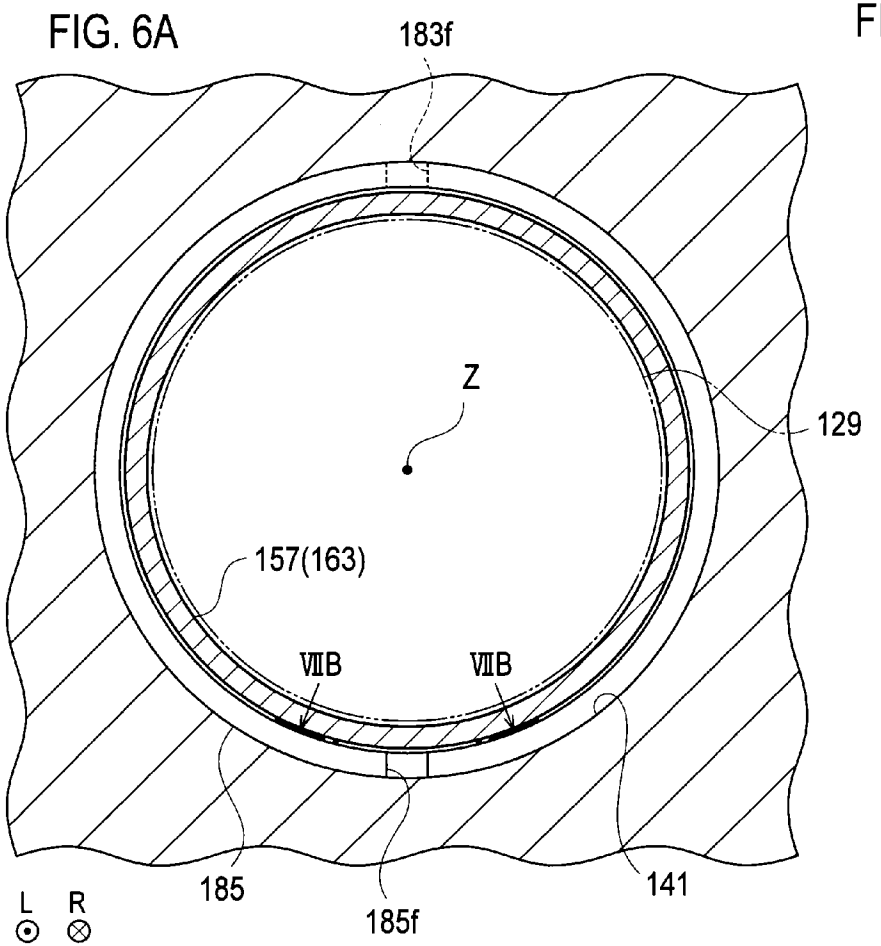
FIG. 6A is a view taken along the VIA-VIA line in FIG. 6B.
Figure 7B:
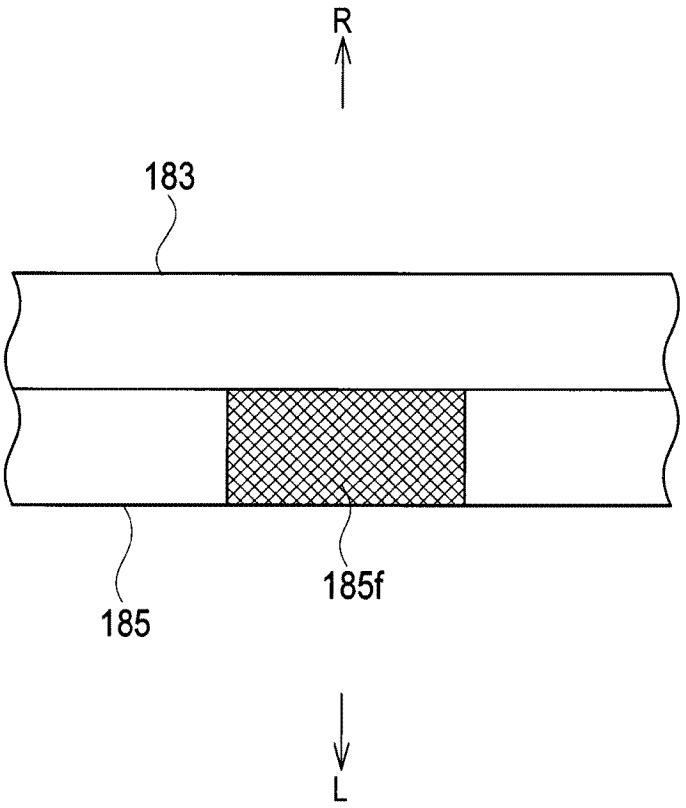
FIG. 7B is an enlarged view taken and viewed along an arrowed line VIIB-VIIB in FIG. 6A.
Figure 7A:
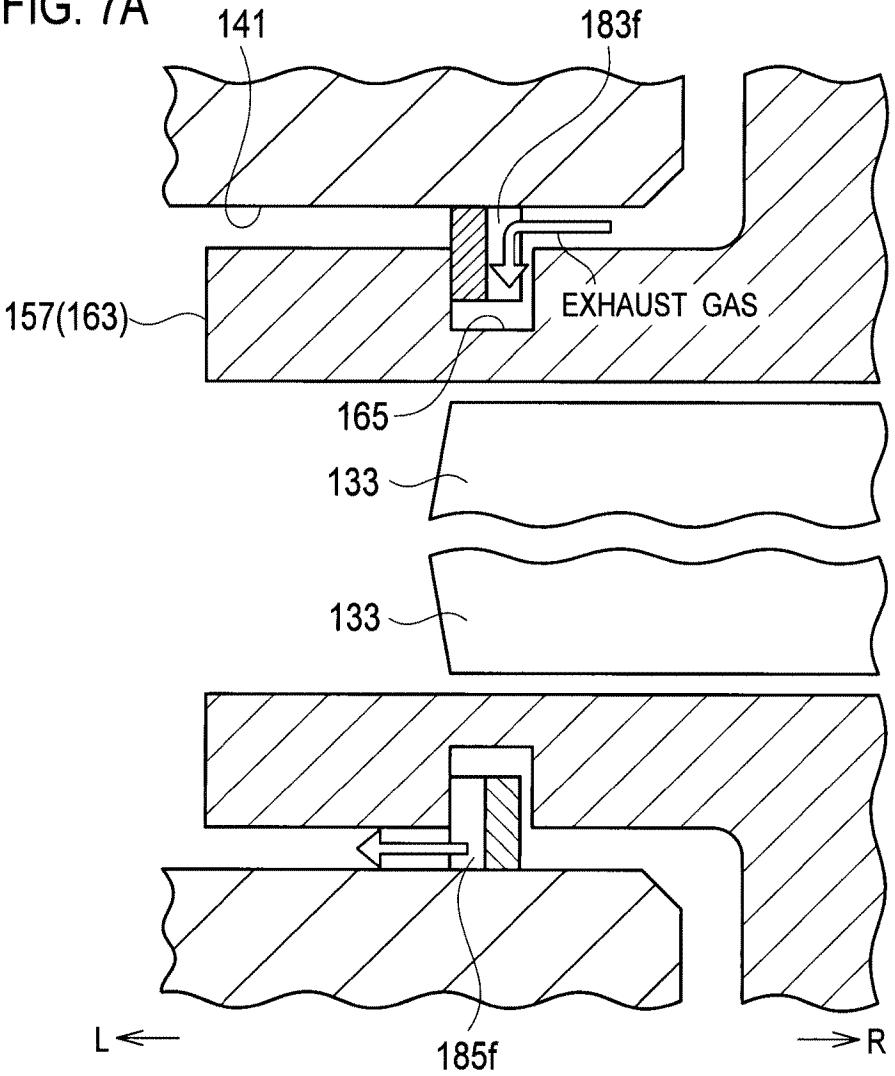
FIG. 7A is an enlarged view showing multiple seal rings and their vicinity in the conventional variable nozzle unit.

The variable nozzle unit 47 may use three (multiple) seal rings 89, 91, and 93 (the most upstream-side seal ring 89, the intermediate seal ring 91, and the most downstream-side seal ring 93) as shown in FIG. 5A and FIG. 5B instead of using the two seal rings 83 and 85 (see FIG. 1B and FIG. 2A). In this case, a circumferential position of an end gap 89*f* of the most upstream-side seal ring 89, a circumferential position of an end gap (not shown) of the intermediate seal ring 91, and a circumferential position of an end gap 93*f* of the most downstream-side seal ring 93 are displaced from one another. Meanwhile, an annular seal flange 95 is formed at an inner peripheral edge portion of either the intermediate seal ring 91 or the most upstream-side seal ring 93. Thus, when the multiple seal rings 89, 91, and 93 are viewed from radially inside, the seal flange 95 of the intermediate seal ring 91 or the most upstream-side seal ring 89 is designed to at least partially occlude the end gap 89*f* of the most downstream-side seal ring 89.

Hence, the modified example of the embodiment of the present invention also exerts the operation and effect similar to those of the above-described embodiment of the present invention.

It is to be noted that the present invention is not limited only to the above descriptions of the embodiment, but can also be embodied in various other modes. For example, regarding the layout of the above-described multiple variable nozzles, the intervals of the variable nozzles adjacent in the circumferential direction do not always have to be constant. In addition, the scope of right encompassed by the present invention shall not be limited to these embodiments.

What is claimed is:

1. A variable nozzle unit disposed between a turbine scroll passage and a gas discharge port inside a turbine housing of a variable-geometry turbocharger in such a way as to surround a turbine impeller, and capable of changing a passage area for an exhaust gas to be supplied to the turbine impeller side, comprising:

a nozzle ring disposed inside the turbine housing;

a shroud ring provided integrally with the nozzle ring at a position away from and opposed to the nozzle ring and including a cylindrical shroud portion placed on an inner peripheral edge side, projecting to the gas discharge port side, and being configured to occlude outer edges of a plurality of turbine blades of the turbine impeller, the shroud portion being placed on an inside of an annular step portion formed on an inlet side of the gas discharge port inside the turbine housing, and the shroud ring including a ring groove formed in an outer peripheral surface of the shroud portion;

a plurality of variable nozzles disposed in a circumferential direction between opposed surfaces of the nozzle ring and the shroud ring, each variable nozzle being turnable in forward and reverse directions about a shaft center in parallel with a shaft center of the turbine impeller; and a plurality of seal rings provided in pressure-contact by their own elastic forces with an inner peripheral surface of the step portion of the turbine housing, an inner peripheral edge portion of each seal ring being fitted into the ring groove of the shroud ring and being configured to suppress leakage of the exhaust gas from the turbine scroll passage side, wherein a seal flange projecting in a downstream direction is formed at an inner peripheral edge portion of at least one of the plurality of seal rings except the most downstream-side seal ring, and when the plurality of seal rings are viewed from radially inside, the seal flange of the one seal ring is designed to at least partially occlude an end gap of the most downstream-side seal ring.

2. The variable nozzle unit according to claim 1, wherein a cross-sectional shape of the one seal ring takes on an L-shape.

3. A variable-geometry turbocharger configured to supercharge air to be supplied to an engine by using energy of an exhaust gas from the engine, comprising the variable nozzle unit according to claim 1.

4. A variable-geometry turbocharger configured to supercharge air to be supplied to an engine by using energy of an exhaust gas from the engine, comprising the variable nozzle unit according to claim 2.

* * * * *